US008400883B2

(12) United States Patent
Lin

(10) Patent No.: US 8,400,883 B2
(45) Date of Patent: Mar. 19, 2013

(54) TIMEPIECE

(76) Inventor: Chia-Yen Lin, Dongguan (CN)

( * ) Notice: Subject to any disclaimer, the term of this patent is extended or adjusted under 35 U.S.C. 154(b) by 99 days.

(21) Appl. No.: 13/207,415

(22) Filed: Aug. 11, 2011

(65) Prior Publication Data

US 2013/0039156 A1 Feb. 14, 2013

(51) Int. Cl.
*G04B 19/04* (2006.01)

(52) U.S. Cl. ..... 368/228

(58) Field of Classification Search ..... 368/223–243, 368/80, 82, 84, 301–307, 285; 362/23
See application file for complete search history.

(56) References Cited

U.S. PATENT DOCUMENTS 5,204,846 A * 4/1993 Brahaney ..... 368/228
6,421,302 B1 * 7/2002 Wimberly ..... 368/223
8,339,903 B2 * 12/2012 Olmes ..... 368/226

* cited by examiner

*Primary Examiner* — Edwin A. Leon
(74) *Attorney, Agent, or Firm* — Lin & Associates IP, Inc.

(57) ABSTRACT

A timepiece includes twelve first light sources spaced in a ring around a 360 degree range on a clock body. The first light sources are controlled to illuminate successively one at a time in a clockwise direction to indicate the hour. The timepiece may include either a minute hand connected with a clock mechanism, or 60 minute strips disposed in radiating directions and evenly spaced around a 360 degree range on the clock body. A plurality of second light sources are distributed along the minute hand or the minute strips. The minute hand is controlled to rotate 360 degrees clockwise. The minute strips are controlled to illuminate alternately in a clockwise direction to indicate the minute. The amount or the position of the illuminated second light sources indicates the second.

18 Claims, 8 Drawing Sheets

TIMEPIECE

BACKGROUND OF THE INVENTION

1. Field of the Invention

The present invention relates to a timepiece that provides a novel time display format.

2. The Prior Arts

Modern clocks or watches are usually classified into two types: mechanical type using rotating hands and digital type using a numeric representation to display time. The digital timepiece uses electronic display to show time as a number. On the other hand, the mechanical timepiece is usually provided with twelve (or less) numbers or symbols that are evenly spaced in a ring around a 360 degree range to represent the hour. The mechanical timepiece also includes a clock mechanism to rotate an hour hand, a minute hand and a second hand. Some of the mechanical timepieces do not have any second hand. In order to provide more varieties to the customers, the time pieces having novel time display formats are appearing in the market.

SUMMARY OF THE INVENTION

A primary objective of the present invention is to provide a timepiece that provides a novel time display format.

One of characteristics of the present invention is that the timepiece only has a minute hand, and without any hour hand or second hand. The minute hand rotates clockwise as conventional timepieces. First light sources serve as a scale of twelve hours and emit light in a sequential order to indicate the hour.

Another characteristic of the present invention is to provide a plurality of minute strips capable of emitting light disposed on the front surface of the clock to serve as a scale of sixty minutes. Thus, the timepiece does not need any hour hand, minute hand or second hand. The minute strips are controlled to emit light alternately one at a time in a clockwise sequential order to indicate the minute. Meanwhile, the first light sources are used to indicate the hour.

Still another characteristic of the present invention is to provide a plurality of second light sources distributed along the minute hand or minute strips. The second light sources are controlled to emit light for indicating the second.

In order to achieve the objective, a timepiece according to an embodiment of the present invention comprises a clock body and twelve first light sources evenly spaced in a ring around a 360 degree range on the clock body. The first light sources are controlled to illuminate successively one at a time in a clockwise direction to indicate the hour. A clock mechanism is disposed in the clock body to drive a minute hand to rotate. A plurality of second light sources distributed along the minute hand. The minute hand rotates 360 degrees in a clockwise direction to indicate the minute, and the second light sources are controlled to illuminate to indicate the second.

According to another embodiment, a timepiece comprises a clock body and twelve first light sources evenly spaced in a ring around a 360 degree range on the clock body. The first light sources are controlled to illuminate sequentially one at a time in a clockwise direction to indicate the hour. The clock body further comprises sixty minute strips disposed in radiating directions and evenly spaced around a 360 degree range on the front surface of the clock body to serve as a scale of sixty minutes. A plurality of second light sources are distributed along each of the minute strips and the minute strips are controlled to illuminate one at a time in a clockwise direction to indicate the minute. The second light sources are controlled to illuminate to indicate the second.

It is preferred to have sixty of the second light sources disposed on the minute hand or each of the minute strips to represent sixty seconds in one minute. The second light sources are controlled to illuminate successively and cumulatively from a first end to a second end of the minute hand (or the minute strip). In other words, one of the second light sources illuminates, it is one second. Two of the second light sources illuminate, it is two seconds, and so on.

According to still another embodiment, the second light sources are controlled to illuminate alternately one at a time in a sequential order from a first end toward a second end of the minute hand or one of the minute strips. In other words, if the second light sources immediately adjacent to the first end illuminates, it indicates the first second. If only the second one of the second light sources from the first end illuminates, it indicates the second second. If only the third one of the second light sources from the first end illuminates, it indicates the third second, and so on.

According to another embodiment, the second light sources distributed along the minute hand or each of the minute strips can be divided into a plurality of regions having equal lengths. These regions are controlled to illuminate successively and cumulatively from a first end toward a second end of the minute hand. For example, if there are thirty regions, each of the regions represents two seconds. In this case, at the first second, the first region would flash once; at the second second, the first region would keep illuminating. At the third second, the first region would keep illuminating and the second region would flash once. At the fourth second, the first and second regions would keep illuminating, and so on.

In still another embodiment, regions are controlled to illuminate successively and individually from a first end toward a second end of the minute hand. For example, if there are six regions, each of the regions represents ten seconds. In this case, from the first to the ninth seconds, the first region would flash once every second. At the tenth second, the first region would keep illuminating. From the eleventh to the nineteenth seconds, the first region keep illuminating, and the second region would flash once every second. At the twentieth second, the first region does not illuminate, and the second region would keep illuminating. From the twenty first to the twenty ninth seconds, the first region do not illuminate, the second region keeps illuminating and the third region flashes every second, and so on.

According to another embodiment, regions are controlled to illuminate successively and individually from a first end toward a second end of the minute hand. For example, if there are six regions, each of the regions represents ten seconds. In this case, from the first to the tenth seconds, the first region would illuminate and flash once every second. From the eleventh to the twentieth seconds, the first region does not illuminate, and the second region would illuminate and flash once every second, and so on.

The first and second light sources are preferred to be light-emitting diodes to save power and provide longer service life.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
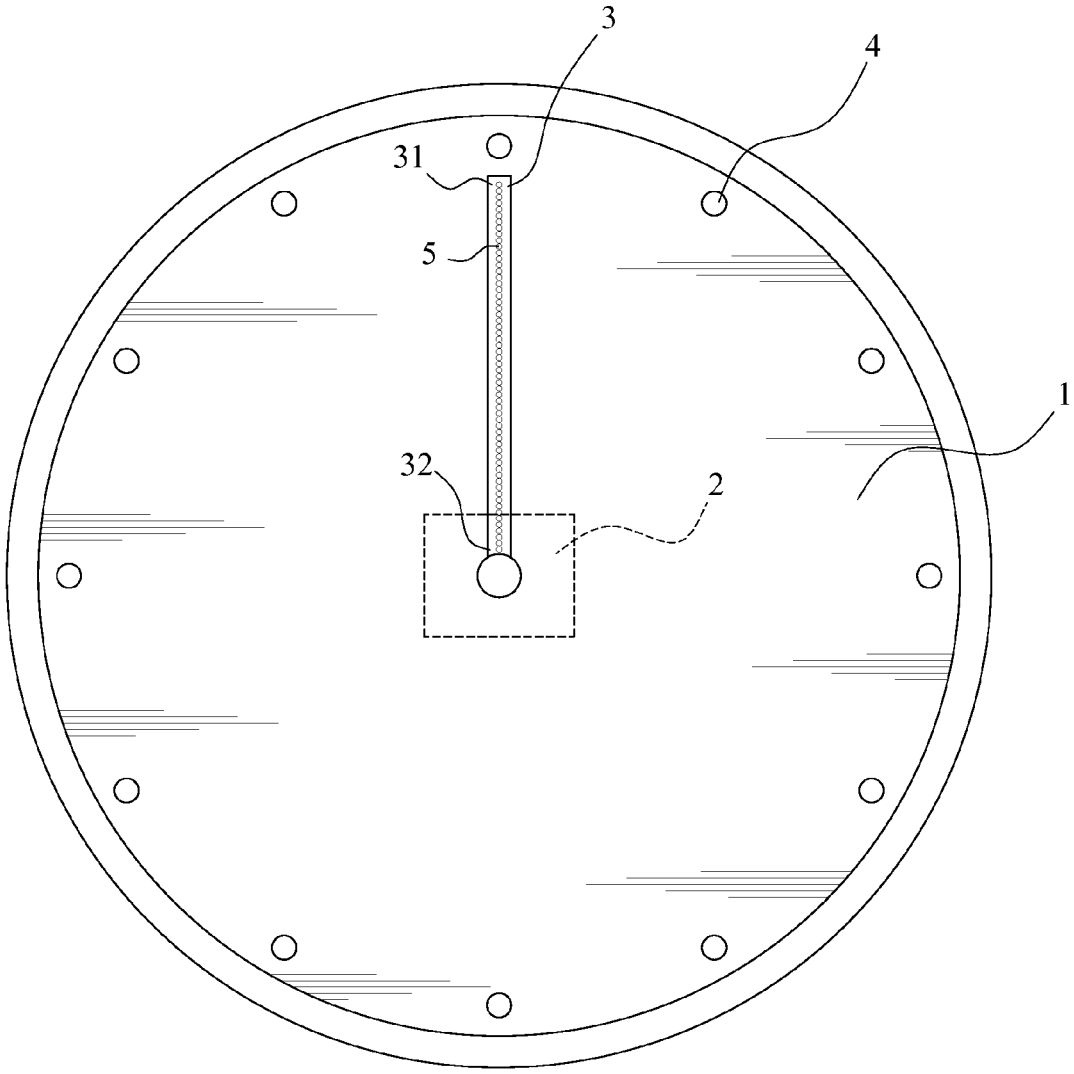
FIG. 1 is a schematic view showing a timepiece according a first embodiment of the present invention.

Referring to FIG. 1, a timepiece according to a first embodiment of the present invention includes a clock body 1 and a plurality of first light sources 4 spaced around a 360 degree range on a front surface of the clock body 1. The first light sources 4 serve as a scale of twelve hours indicating the hours. Thus, it is preferred to have twelve first light sources 4 and the number of the first light source 4 may also be two, three, four or six. The first light sources 4 also serves as a scale of 60 minutes/seconds and each interval represents 5 minutes/seconds. A clock mechanism 2 is disposed at a rear or an interior of the clock body 1. The clock mechanism 2 has an axle that protrudes out of the front surface of the clock body 1 and a minute hand 3 is connected with the axle. The clock mechanism 2 controls the minute hand 3 to rotate clockwise such that the minute hand 3 can indicate the minute by telling the angular position of the minute hand 3 relative to the first light sources 4. The minute hand 3 has a first end 31 disposed at a free end thereof and a second end 32 connected with the axle of the clock mechanism 2. The minute hand 3 further includes a plurality of second light sources 5 distributed along the minute hand 3 from the first end 31 to the second end 32. The first and second light sources 4 and 5 are electrically connected with a control circuit (not shown in drawings) disposed in the clock body 1, which controls the illumination of the first and second light sources 4 and 5. For displaying time, one of the first light sources 4 is controlled by the control circuit to illuminate to indicate the hour and the minute hand 3 is rotated by the clock mechanism 2 to show the time in minute. The second light sources 5 are controlled to switch on from the first end 31 to the second end 32 (or from the second end 32 to the first end 31) of the minute hand 3 successively and cumulatively, and therefore the amount of the illuminated second light sources 5 indicates the second. Therefore, it is preferred to have sixty second light sources 5 and the number of the second light source 5 may also be two, three, four, five, six, ten, twelve, fifteen, twenty or thirty. According to a second embodiment, the second light sources 5 may also be switched on successively and individually from the first end 31 toward the second end 32 (or from the second end 32 toward the first end 31) of the minute hand 3, and only one of the second light sources 5 illuminates in a sequential order at a given time. Therefore, the alternately illuminated second light sources 5 show the elapsed seconds. Light-emitting diodes (LEDs) are preferred to be used as the first and second light sources 4, 5 to save energy and provide longer service life.

Figure 2:
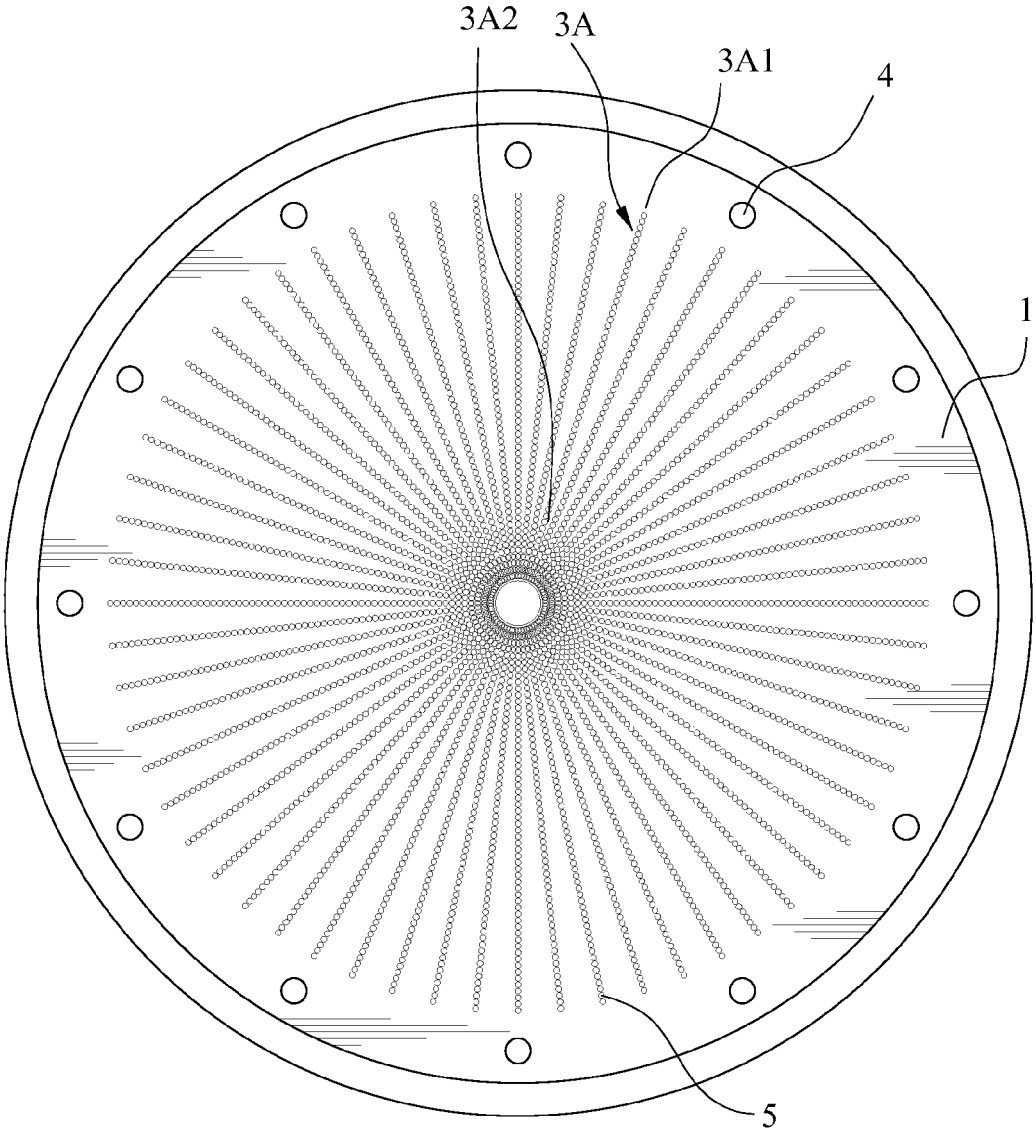
FIG. 2 is a schematic view showing a timepiece according a third embodiment of the present invention.

Referring to FIG. 2, a timepiece according to a third embodiment of the present invention includes a clock body 1 and a plurality of first light sources 4 evenly spaced in a ring around a 360 degree range on a front surface of the clock body 1. The first light sources 4 serve as a scale of twelve hours indicating the hours in a 12-hour cycle. The timepiece according to the third embodiment has twelve first light sources 4. A plurality of minute strips 3A are disposed in radiating directions and spaced around a 360 degree range on the front surface of the clock body 1. The minute strips 3A serves as a scale of sixty minutes indicating the minutes. According to the third embodiment, there are sixty minute strips 3A evenly spaced around a 360 degree range and each interval between two immediately adjacent minute strips 3A represent one minutes. The number of the minute strips 3A may also be two, three, four, five, six, ten, twelve, fifteen, twenty or thirty. The first light sources 4 and the minute strips 3A may also be unevenly spaced around a 360 degree range and each interval between two immediately adjacent first light sources 4 or the minute strips 3A may represent different time periods. For example, the timepiece has eight minute strips 3A located at 0, 30, 60, 90, 180, 210, 240 and 270 degrees to indicate 0, 5, 10, 15, 30, 35, 40 and 45 minutes. Each of the minute strips 3A has a first end 3A1 disposed at a distal end thereof and a second end 3A2 disposed at a proximal end thereof. A plurality of second light sources 5 are distributed along each of the minute strips 3A from the first end 3A1 to the second end 3A2. The first and second light sources 4 and 5 are electrically connected with a control circuit (not shown) disposed in the clock body 1, which can control the illumination of the first and second light sources 4 and 5. For displaying time, the control circuit controls one of the first light sources 4 to illuminate to indicate the hour. The second light sources 5 disposed on one of the minute strips 3A are controlled by the control circuit to illuminate to indicate the minute. In the mean times, the second light sources 5 are controlled to switch on from the first end 3A1 to the second end 3A2 (or from the second end 3A2 to the first end 3A1) of the minute strip 3A successively and cumulatively, and therefore the amount of the illuminated second light sources 5 indicates the second. For example, if a half of the second light sources 5 disposed on the minute strip 3A that point to the 3-o'clock direction illuminates, it is fifteen minutes and thirty seconds. According to a fourth embodiment, the second light sources 5 may also be switched on successively and individually from the first end 3A1 toward the second end 3A2 of the minute strip 3A, and only one of the second light sources 5 illuminates in a sequential order at a given time. Therefore, the alternately illuminated second light sources 5 show the elapsed seconds. For example, if the second light source 5 disposed on the minute strip 3A that point to the 3-o'clock direction and disposed half way between the first end 3A1 and the second end 3A2 illuminates, it is fifteen minutes and thirty seconds.

Figure 3:
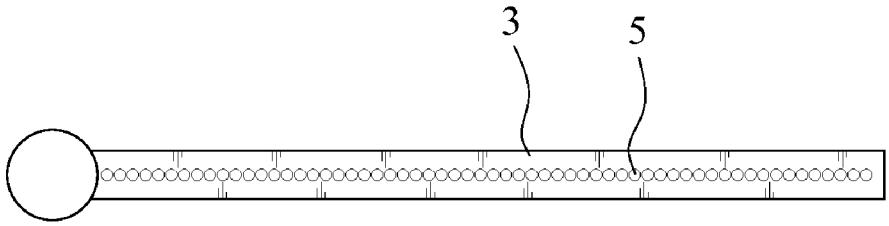
FIG. 3 is a schematic view showing a minute hand of the timepiece according to the first embodiment or a minute strip of the timepiece according to the third embodiment.

Referring to FIG. 3, in the aforementioned embodiments, the second light sources 5 disposed on the minute hand 3 (or minute strips 3A) are LEDs and there are sixty LEDs representing sixty seconds in one minute. The first and second ends 31, 32 (or 3A1, 3A2) are ends adjacent to and away from the first light sources 4, respectively. The second light sources 5 may illuminates from the first end 31 (or 3A1) to the second end 32 (or 3A2) of the minute hand 3 (or the minute strip 3A) successively and cumulatively, and therefore the amount of the illuminated second light sources 5 indicates the second. When all sixty of the LEDs disposed on the minute hand 3 (or all sixty of the LEDs disposed on one of the minute strips 3A) illuminate, it is the 60th second. Similarly, when a half of the LEDs disposed on the minute hand 3 (or thirty the LEDs disposed on one of the minute strips 3A) illuminates, it is the 30th second. The second light sources 5 may also be illuminated successively and individually from the first end 31 (or 3A1) toward the second end 32 (or 3A2) of the minute hand 3 (or the minute strip 3A). At a given time, only one of the second light sources 5 illuminates in a sequential order. Therefore, the alternately illuminated second light sources 5 show the elapsed seconds. When the LED disposed at the second end 32 (or 3A2) illuminates, it is the 60th second; when the LED disposed exactly half way between the first end 31 (or 3A1) and the second end 32 (or 3A2) illuminates, it is the 30th second. As time elapses, the LEDs are controlled by the control circuit to be switched on to illuminate successively one at a time in a sequential order from the first end 31 (or 3A1) toward the second end 32 (or 3A2) of the minute hand 3 (or minute strips 3A) to count the elapsed seconds.

Figure 4:
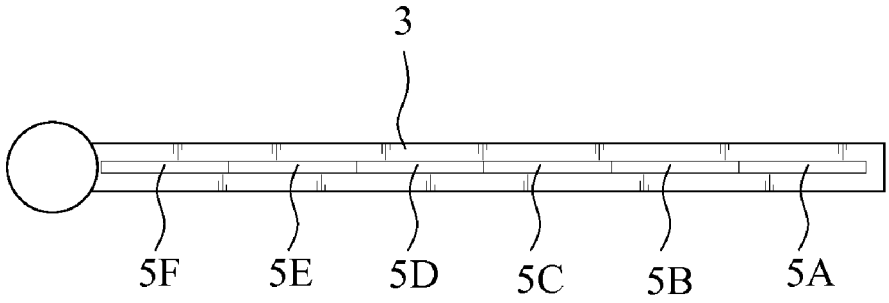
FIG. 4 is a schematic view showing the second light sources divided into a plurality of regions along the minute hand (or the minute strip)

According to a fifth embodiment, the second light sources 5 on the minute hand 3 (or one of the minute strips 3A) includes a plurality of regions having a predetermined length. Referring to FIG. 4, there are six regions 5A, 5B, 5C, 5D, 5E and 5F. The regions 5A to 5F are controlled by the control circuit to illuminate successively and cumulatively, or to illuminate successively and individually from the first end 31 (or 3A1) toward the second end 32 (or 3A2) of the minute hand 3 (or the minute strip 3A). Each of the regions 5A to 5F represents ten seconds. If there are thirty regions, each region represents two seconds. If there are twelve regions, each region represents five seconds.

Figure 5:
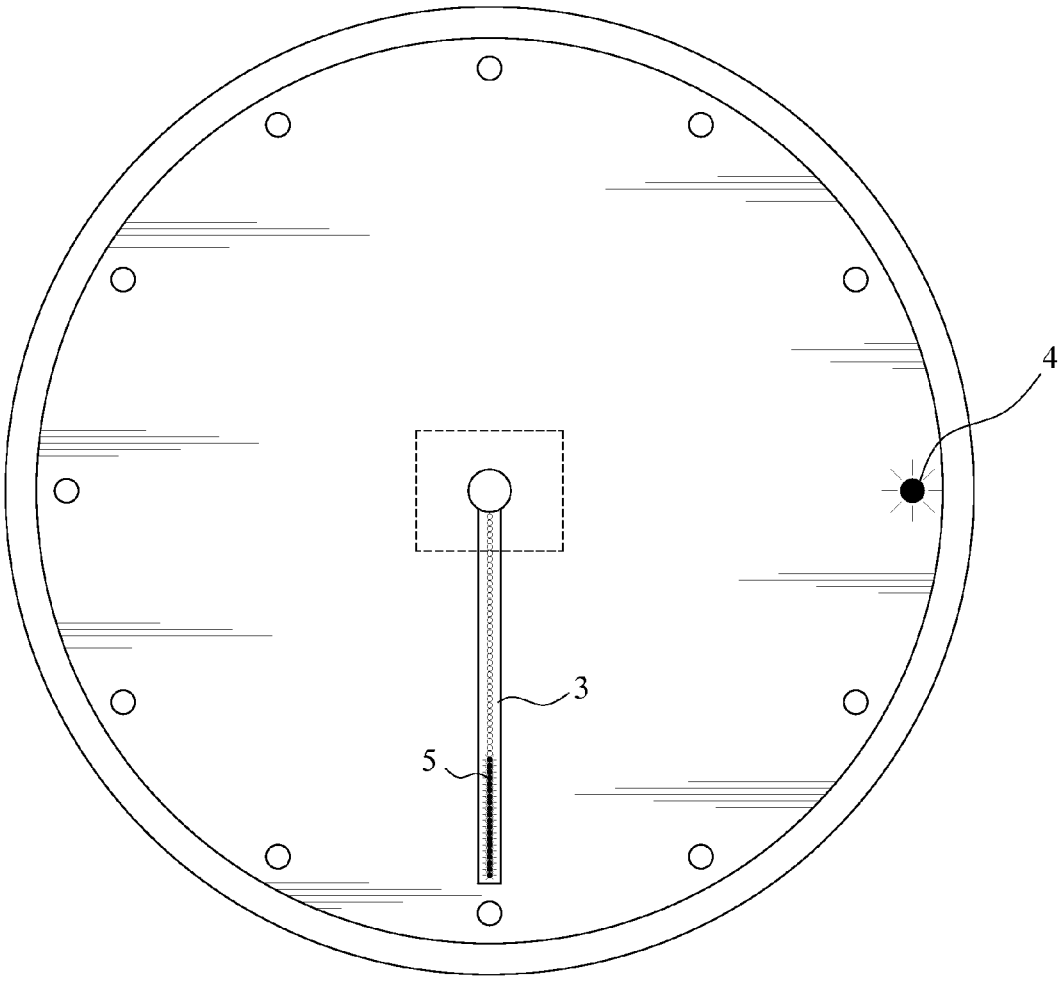
FIG. 5 is a schematic view showing the timepiece according the first embodiment, and the time indicated by the timepiece is thirty minutes and twenty seconds after three o'clock.

FIG. 5 illustrates the timepiece according to the first embodiment of the present invention. The minute hand 3 comprises sixty of the second light sources 5 disposed thereon. At this time, the first light source 4 in the three-o'clock direction emits light, the minute hand 3 points to the six-o'clock direction and twenty of the second light sources 5 close to the first end 31 of the minute hand 3 illuminate. Therefore, it is thirty minutes and twenty seconds after three o'clock.

Figure 6:
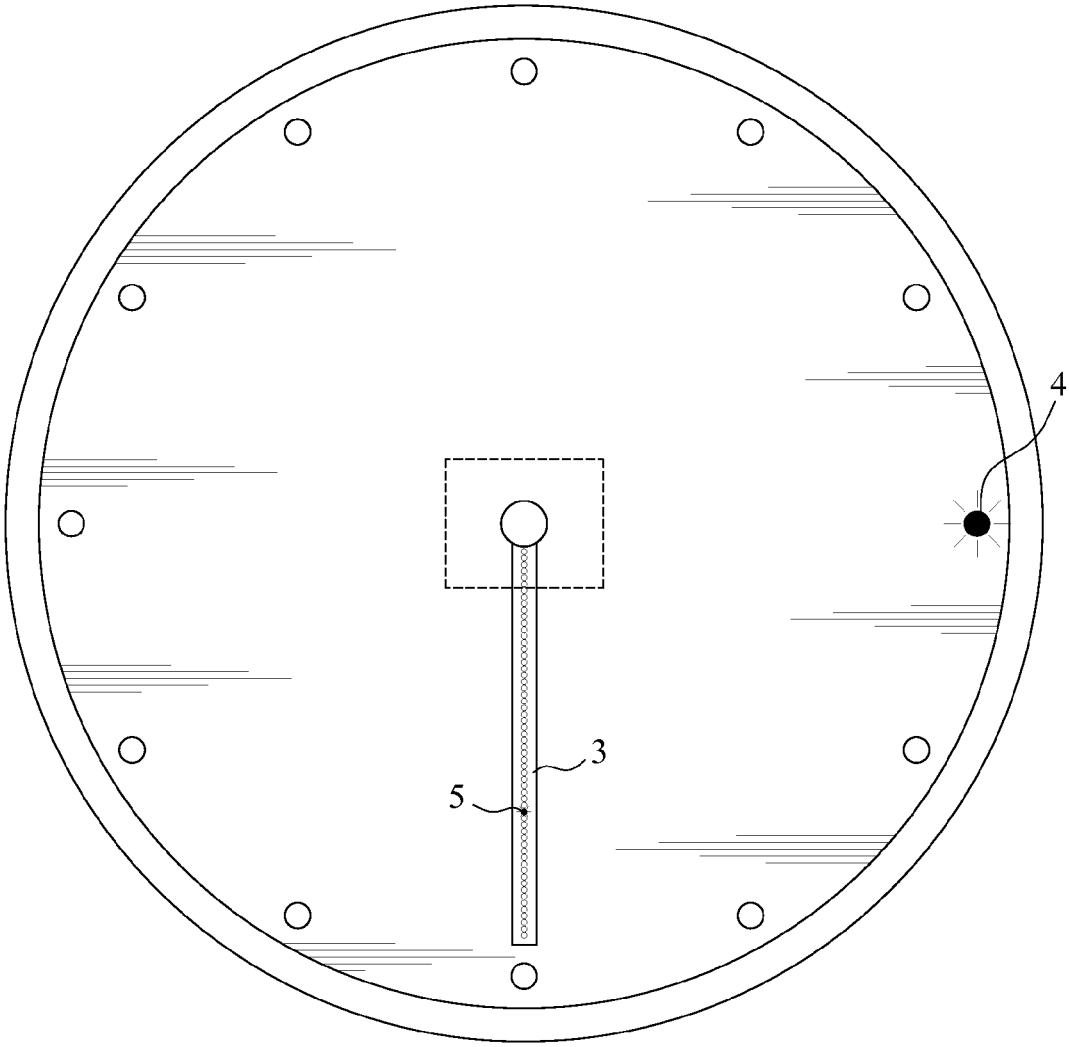
FIG. 6 is a schematic view showing the timepiece according the second embodiment, and the time indicated by the timepiece is thirty minutes and twenty seconds after three o'clock.

Referring to FIG. 6, the timepiece according to the second embodiment of the present invention has sixty of the second light sources 5 disposed on the minute hand 3. At this time, the first light source 4 in the direction of three o'clock illuminates, the minute hand 3 points to the direction of six o'clock, and the twentieth second light sources 5 from the first end 31 of the minute hand 3 illuminates. Thus, it is thirty minutes and twenty seconds after three o'clock.

Figure 7:
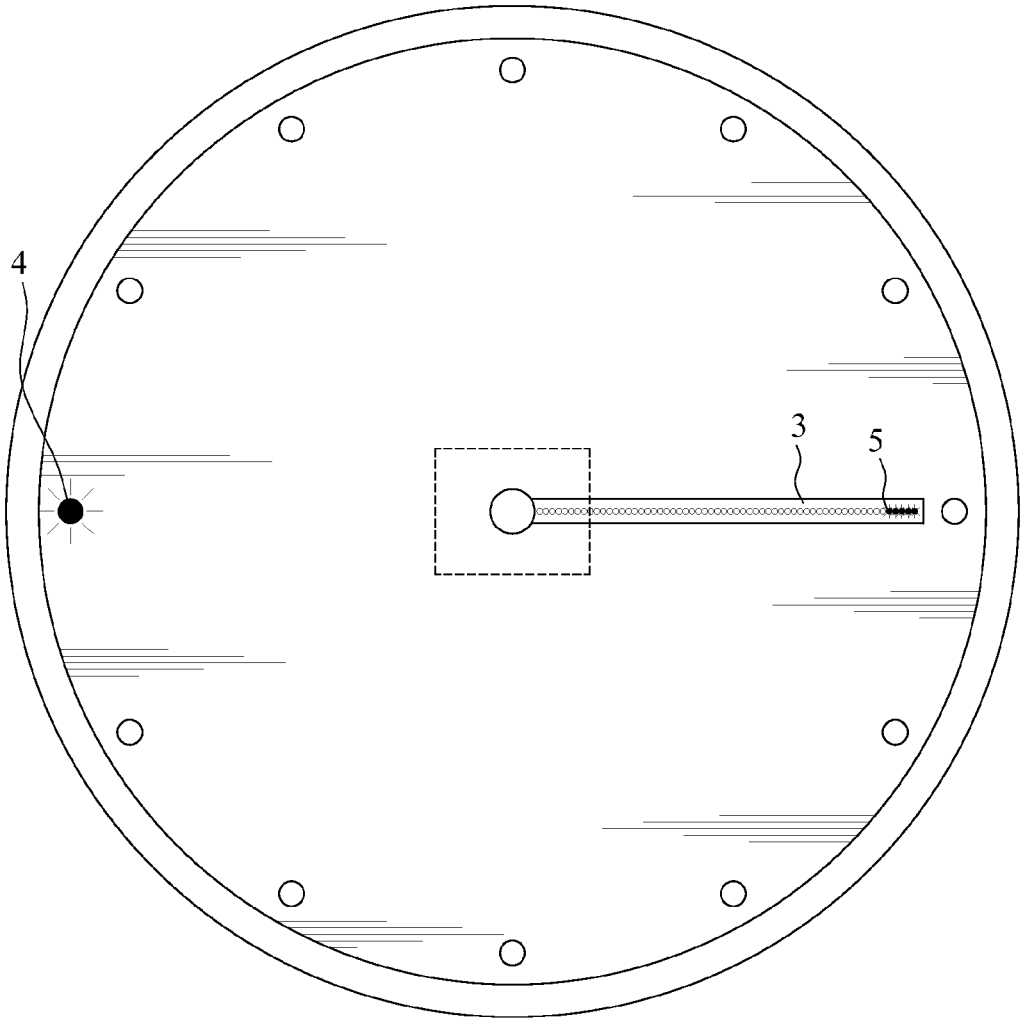
FIG. 7 is a schematic view showing the timepiece according the first embodiment, and the time indicated by the timepiece is fifteen minutes and five seconds after nine o'clock.

FIG. 7 illustrates the timepiece according to the first embodiment and the minute hand 3 has sixty of the second light sources 5. At this time, the first light source 4 in the direction of nine o'clock illuminates, the minute hand 3 points to the direction of three o'clock, and five of the second light sources 5 from the first end 31 of the minute hand 3 illuminate. Thus, it is fifteen minutes and five seconds after nine o'clock.

Figure 8:
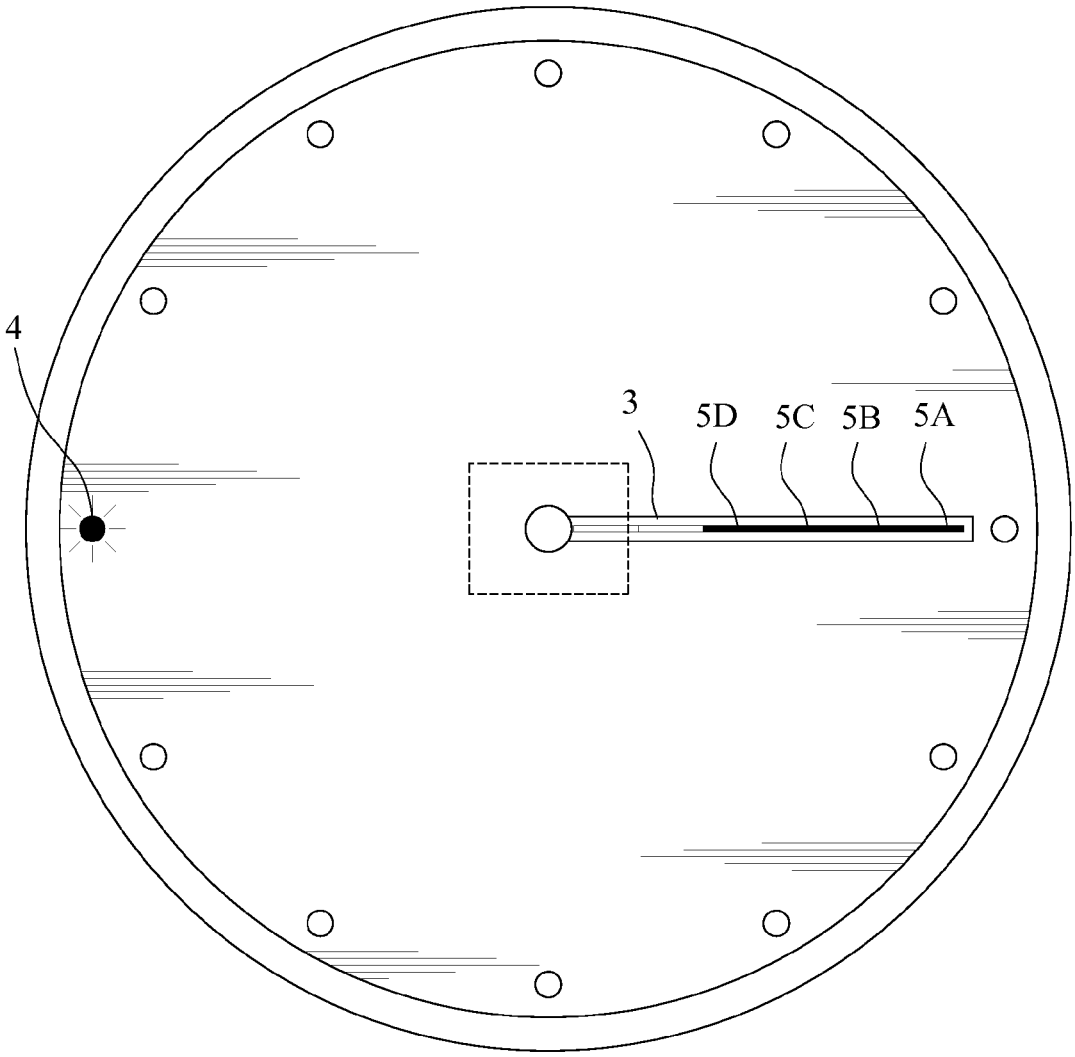
FIG. 8 is a schematic view showing the timepiece according the fifth embodiment, and the time indicated by the timepiece is fifteen minutes and forty seconds after nine o'clock.

FIG. 8 illustrates the second light source 5 on the minute hand 3 being divided into the first region 5A, second region 5B, third region 5C, fourth region 5D, fifth region 5E and sixth region 5F. At this time, the first light source 4 in the direction of nine o'clock emits light, the minute hand 3 points to the direction of three o'clock and the second light sources 5 from the first region 5A to the fourth region 5D illuminate. Therefore, it is fifteen minutes and forty seconds after 9 o'clock.

Figure 9:
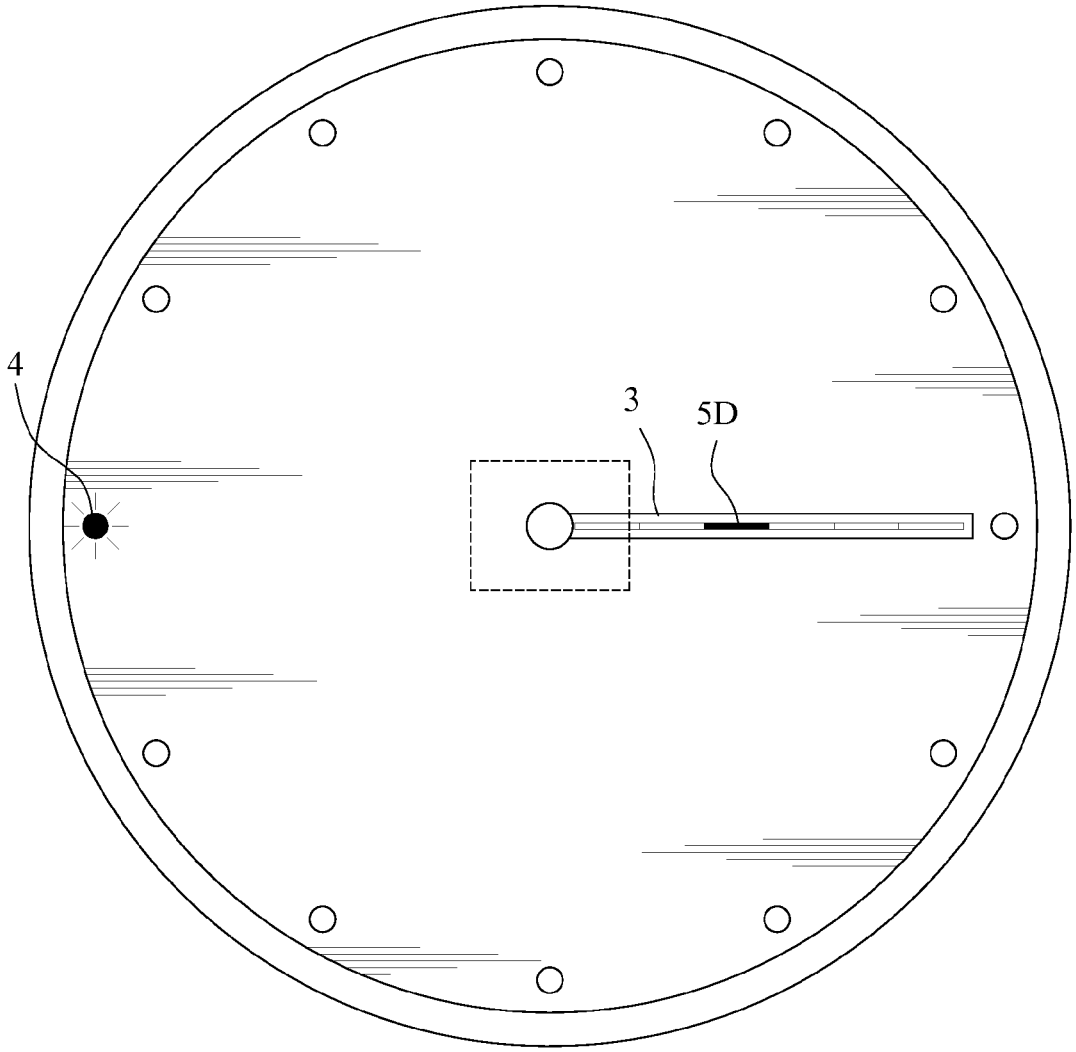
FIG. 9 is a schematic view showing the timepiece according the sixth embodiment, and the time indicated by the timepiece is fifteen minutes and forty seconds after nine o'clock.

Similar to FIG. 8, FIG. 9 illustrates the second light source 5 on the minute hand 3 being divided into six regions 5A to 5F. At this time, the first light source 4 in the direction of nine o'clock emits light, the minute hand 3 points to the direction of three o'clock, and the second light source 5 of the fourth region 5D illuminates. Therefore, it is fifteen minutes and forty seconds after 9 o'clock.

The foregoing description is intended to only provide illustrative ways of implementing the present invention, and should not be construed as limitations to the scope of the present invention. While the foregoing is directed to embodiments of the present invention, other and further embodiments of the invention may thus be devised without departing from the basic scope thereof, and the scope thereof is determined by the claims that follow.

What is claimed is:

1. A timepiece, comprising:
a clock body;
a plurality of first light sources spaced around a 360 degree range on the clock body, the first light sources being controlled to illuminate successively one at a time in a clockwise direction to indicate the hour;
a clock mechanism disposed in the clock body and comprising a minute hand, the minute hand being controlled to rotate 360 degrees in a clockwise direction to indicate the minute; and
a plurality of second light sources distributed along the minute hand, and the second light sources being controlled to illuminate to indicate the second.

2. The timepiece as claimed in claim 1, wherein the number of the first light sources is two, three, four, six or twelve.

3. The timepiece as claimed in claim 1, wherein the number of the second light sources is two, three, four, five, six, ten, twelve, fifteen, twenty, thirty or sixty.

4. The timepiece as claimed in claim 1, the second light sources are controlled to switch on and emit light successively and cumulatively from a first end to a second end of the minute hand.

5. The timepiece as claimed in claim 1, wherein the second light sources are controlled to switch on and emit light successively and individually from a first end to a second end of the minute hand.

6. The timepiece as claimed in claim 1, wherein the second light sources are divided into two, three, four, five, six, ten, twelve, fifteen, twenty or thirty regions, each of the regions has a predetermined length.

7. The timepiece as claimed in claim 6, wherein the regions illuminate successively and cumulatively from a first end to a second end of the minute hand to indicate the second.

8. The timepiece as claimed in claim 6, wherein the regions illuminate successively and individually from a first end to a second end of the minute hand to indicate the second.

9. The timepiece as claimed in claim 1, wherein the first and second light sources comprise light-emitting diodes.

10. A timepiece, comprising:
a clock body;
a plurality of first light sources spaced around a 360 degree range on the clock body, the first light sources being controlled to illuminate successively one at a time in a clockwise direction to indicate the hour; and
a plurality of minute strips disposed in radiating directions and spaced around a 360 degree range on the clock body, a plurality of second light sources distributed along each of the minute strips, the minute strips being controlled to illuminate one at a time in a clockwise direction to indicate the minute, the second light sources on the illuminated minute strip being controlled to illuminate and a position or an amount of the illuminated second light sources being used to indicate the second.

11. The timepiece as claimed in claim 10, wherein the number of the first light sources is two, three, four, six or twelve.

12. The timepiece as claimed in claim 10, wherein the number of the second light sources is two, three, four, five, six, ten, twelve, fifteen, twenty, thirty or sixty.

13. The timepiece as claimed in claim 10, wherein the second light sources are controlled to switch on and emit light successively and cumulatively from a first end to a second end of the minute strip.

14. The timepiece as claimed in claim 10, wherein the second light sources are controlled to switch on and emit light successively and individually from a first end to a second end of the minute strip.

15. The timepiece as claimed in claim 10, wherein the second light sources are divided into two, three, four, five, six, ten, twelve, fifteen, twenty or thirty regions, each of the regions has a predetermined length.

16. The timepiece as claimed in claim 15, wherein the regions illuminate successively and cumulatively from a first end to a second end of the minute strip to indicate the second.

17. The timepiece as claimed in claim 15, wherein the regions illuminate successively and individually from a first end to a second end of the minute strip to indicate the second.

18. The timepiece as claimed in any of claim 10, wherein the first and second light sources comprise light-emitting diodes.

* * * * *